US008806932B2

(12) United States Patent
Roessler

(10) Patent No.: US 8,806,932 B2
(45) Date of Patent: Aug. 19, 2014

(54) CYLINDRICAL SHAPED SNORKEL INTERFACE ON EVALUATION PROBE

(75) Inventor: Dennis Eugene Roessler, Fort Worth, TX (US)

(73) Assignee: Weatherford/Lamb, Inc., Houston, TX (US)

( * ) Notice: Subject to any disclaimer, the term of this patent is extended or adjusted under 35 U.S.C. 154(b) by 414 days.

(21) Appl. No.: 13/105,973

(22) Filed: May 12, 2011

(65) Prior Publication Data

US 2012/0234088 A1 Sep. 20, 2012

Related U.S. Application Data

(60) Provisional application No. 61/454,281, filed on Mar. 18, 2011.

(51) Int. Cl.
*E21B 49/10* (2006.01)

(52) U.S. Cl.
USPC ..... 73/152.26

(58) Field of Classification Search
USPC ..... 73/152.24–152.26; 166/100, 264
See application file for complete search history.

(56) References Cited

U.S. PATENT DOCUMENTS

| | | | | | |
|---|---|---|---|---|---|
| 2,674,313 | A | * | 4/1954 | Chambers | 166/63 |
| 2,892,501 | A | * | 6/1959 | Boller | 166/100 |
| 2,927,459 | A | * | 3/1960 | Farrington | 73/152.59 |
| 3,062,294 | A | * | 11/1962 | Huitt et al. | 166/177.5 |
| 3,173,485 | A | * | 3/1965 | Bretzke, Jr. | 166/100 |
| 3,330,367 | A | * | 7/1967 | Redwine | 175/77 |
| 3,344,860 | A | * | 10/1967 | Voetter | 166/100 |
| 3,530,933 | A | * | 9/1970 | Whitten | 166/100 |
| 3,565,169 | A | * | 2/1971 | Bell | 166/100 |
| 3,732,143 | A | * | 5/1973 | Joosse | 175/6 |
| 3,864,970 | A | * | 2/1975 | Bell | 73/152.25 |
| 4,285,398 | A | * | 8/1981 | Zandmer et al. | 166/100 |
| 4,287,946 | A | * | 9/1981 | Brieger | 166/100 |
| 4,533,301 | A | * | 8/1985 | Foster | 417/437 |
| 4,951,749 | A | * | 8/1990 | Carroll | 166/264 |
| 5,056,595 | A | * | 10/1991 | Desbrandes | 166/100 |
| 6,026,915 | A | * | 2/2000 | Smith et al. | 175/50 |
| 6,157,893 | A | * | 12/2000 | Berger et al. | 702/9 |

(Continued)

FOREIGN PATENT DOCUMENTS

| | | |
|---|---|---|
| EP | 1798368 | 6/2007 |
| GB | 2384796 | 8/2003 |
| WO | 03097999 | 11/2003 |
| WO | 2007005071 | 1/2007 |

OTHER PUBLICATIONS

Great Britain Search Report and Search Opinion for GB Application No. 1108850.7, dated Jun. 29, 2011, 4 pages.

*Primary Examiner* — John Fitzgerald
(74) *Attorney, Agent, or Firm* — Wong, Cabello, Lutsch, Rutherford & Brucculeri LLP

(57) ABSTRACT

A snorkel and pad for use with a formation testing tool is formed with a cylindrical geometry at the interface where the snorkel and pad contacts the inner surface of a borehole. The cylindrical geometry reduces or eliminates gaps that a flat interface surface would leave between the snorkel and the inner surface of the borehole, reducing the possibility that a surrounding pad could extrude through the gap. The snorkel is prevented from rotating during operation, ensuring the correct orientation of the cylindrical geometry interface surface relative to the inner surface of the borehole. The snorkel may be used as part of a formation testing system.

22 Claims, 9 Drawing Sheets

(56) References Cited

U.S. PATENT DOCUMENTS

| | | | | |
|---|---|---|---|---|
| 6,729,399 | B2 * | 5/2004 | Follini et al. | 166/264 |
| 7,584,655 | B2 * | 9/2009 | van Zuilekom et al. | 73/152.26 |
| 7,690,423 | B2 * | 4/2010 | Del Campo et al. | 166/100 |
| 7,793,713 | B2 * | 9/2010 | Nold et al. | 166/100 |
| 7,966,875 | B2 * | 6/2011 | Proett et al. | 73/152.22 |
| 8,047,286 | B2 * | 11/2011 | Zazovsky et al. | 166/264 |
| 8,113,280 | B2 * | 2/2012 | Sherrill | 166/264 |
| 8,220,536 | B2 * | 7/2012 | Tao et al. | 166/100 |
| 2001/0035289 | A1 * | 11/2001 | Runia | 166/66 |
| 2003/0145652 | A1 * | 8/2003 | Arian | 73/152.26 |
| 2004/0079527 | A1 * | 4/2004 | Meister et al. | 166/264 |
| 2005/0072565 | A1 * | 4/2005 | Segura et al. | 166/100 |
| 2005/0109538 | A1 * | 5/2005 | Fisseler et al. | 175/20 |
| 2007/0007008 | A1 * | 1/2007 | Sherrill | 166/264 |
| 2007/0151727 | A1 * | 7/2007 | Tao et al. | 166/250.1 |
| 2007/0181341 | A1 * | 8/2007 | Segura et al. | 175/50 |
| 2007/0284099 | A1 * | 12/2007 | DiFoggio et al. | 166/264 |
| 2008/0156487 | A1 * | 7/2008 | Zazovsky et al. | 166/264 |
| 2008/0295588 | A1 | 12/2008 | van Zuilekom et al. | |
| 2009/0283266 | A1 * | 11/2009 | Nold et al. | 166/264 |
| 2010/0155053 | A1 * | 6/2010 | Tao et al. | 166/119 |
| 2011/0011583 | A1 * | 1/2011 | Niconoff | 166/264 |
| 2011/0162836 | A1 * | 7/2011 | Church | 166/264 |
| 2011/0284212 | A1 * | 11/2011 | Tao et al. | 166/119 |
| 2012/0111632 | A1 * | 5/2012 | Sherrill et al. | 175/50 |

* cited by examiner

SECTION B-B

SECTION A-A

SECTION A-A

CYLINDRICAL SHAPED SNORKEL INTERFACE ON EVALUATION PROBE

TECHNICAL FIELD

The present invention relates to the field of formation testing and formation fluid sampling, and in particular to the determination, within the borehole, of various physical properties of the formation or the reservoir and of the fluids contained therein using a downhole instrument or "tool" comprising a snorkel interface.

BACKGROUND ART

A variety of systems are used in borehole geophysical exploration and production operations to determine chemical and physical parameters of materials in the borehole environs. The borehole environs include materials, such as fluids or formations, near a borehole as well as materials, such as fluids, within the borehole. The various systems include, but are not limited to, formation testers and borehole fluid analysis systems conveyed within the borehole. In all of these systems, it is preferred to make all measurements in real-time and within instrumentation in the borehole. However, methods that collect data and fluids for later retrieval and processing are not precluded.

Formation tester systems are used in the oil and gas industry primarily to measure pressure and other reservoir parameters of a formation penetrated by a borehole, and to collect and analyze fluids from the borehole environs to determine major constituents within the fluid. Formation testing systems are also used to determine a variety of properties of the formation or reservoir near the borehole. These formation or reservoir properties, combined with in situ or uphole analyses of physical and chemical properties of the formation fluid, can be used to predict and evaluate production prospects of reservoirs penetrated by the borehole. By definition, formation fluid refers to any and all fluid including any mixture of fluids.

Formation tester tools can be conveyed along the borehole by variety of means including, but not limited to, a single or multi-conductor wireline, a "slick" line, a drill string, a permanent completion string, or a string of coiled tubing. Formation tester tools may be designed for wireline usage or as part of a drill string. Tool response data and information as well as tool operational data can be transferred to and from the surface of the earth using wireline, coiled tubing and drill string telemetry systems. Alternately, tool response data and information can be stored in memory within the tool for subsequent retrieval at the surface of the earth.

Formation tester tools typically comprise a fluid flow line cooperating with a pump to draw fluid into the formation tester tool for analysis, sampling, and optionally for subsequent exhausting the fluid into the borehole. Typically, a sampling pad is pressed against the wall of the borehole. A probe port or "snorkel" is extended from the center of the pad and through any mudcake to make contact with formation material. The snorkel and pad are designed to isolate the pressure and fluid movement to and from the formation and the wellbore. The best sample to be analyzed and/or taken should be from an undisturbed formation without any wellbore contamination.

Fluid is drawn into the formation tester tool via a flow line cooperating with the snorkel. Fluid is sampled for subsequent retrieval at the surface of the earth, or alternately exhausted to the borehole via the flow lines and pump systems.

When performing formation tester probe operations in a wellbore, it is critical to maintain a proper seal against the formation while performing a drawdown/build-up sequence. As significant differential pressures (1,000's of psi) can be created during this operation, the sampling pad, typically made of an elastomeric material, may extrude between the surface of the wellbore and the interface of the snorkel. Generally, soft pliable rubber is wanted for the pad seal, however, this is more likely to extrude.

BRIEF DESCRIPTION OF DRAWINGS

The accompanying drawings, which are incorporated in and constitute a part of this specification, illustrate an implementation of apparatus and methods consistent with the present invention and, together with the detailed description, serve to explain advantages and principles consistent with the invention. In the drawings.

DESCRIPTION OF EMBODIMENTS

In the following description, for purposes of explanation, numerous specific details are set forth in order to provide a thorough understanding of the invention. It will be apparent, however, to one skilled in the art that the invention may be practiced without these specific details. In other instances, structure and devices are shown in block diagram form in order to avoid obscuring the invention. References to numbers without subscripts or suffixes are understood to reference all instance of subscripts and suffixes corresponding to the referenced number. Moreover, the language used in this disclosure has been principally selected for readability and instructional purposes, and may not have been selected to delineate or circumscribe the inventive subject matter, resort to the claims being necessary to determine such inventive subject matter. Reference in the specification to "one embodiment" or to "an embodiment" means that a particular feature, structure, or characteristic described in connection with the embodiments is included in at least one embodiment of the invention, and multiple references to "one embodiment" or "an embodiment" should not be understood as necessarily all referring to the same embodiment.

Wellbores are effectively circular. However, this is not required. The more advanced formation testers have pad and snorkel assemblies that will pivot and tilt so that the tester will provide a better seal to the formation. Conventional (prior art) snorkel designs have a flat surface, so that the edges of the snorkel rest on the curved surface of the wellbore. This leaves a gap between the snorkel and the wellbore that is at a maximum in a plane orthogonal to the initial contact between the snorkel and the wellbore. In various embodiments described below, the interface surface of the snorkel is formed with a cylindrical geometry to minimize the extrusion gap between the snorkel and the wellbore. The snorkel may be configured to prevent rotation of the snorkel, to ensure that the cylindrical geometry is correctly oriented with the wellbore surface.

Figure 1:
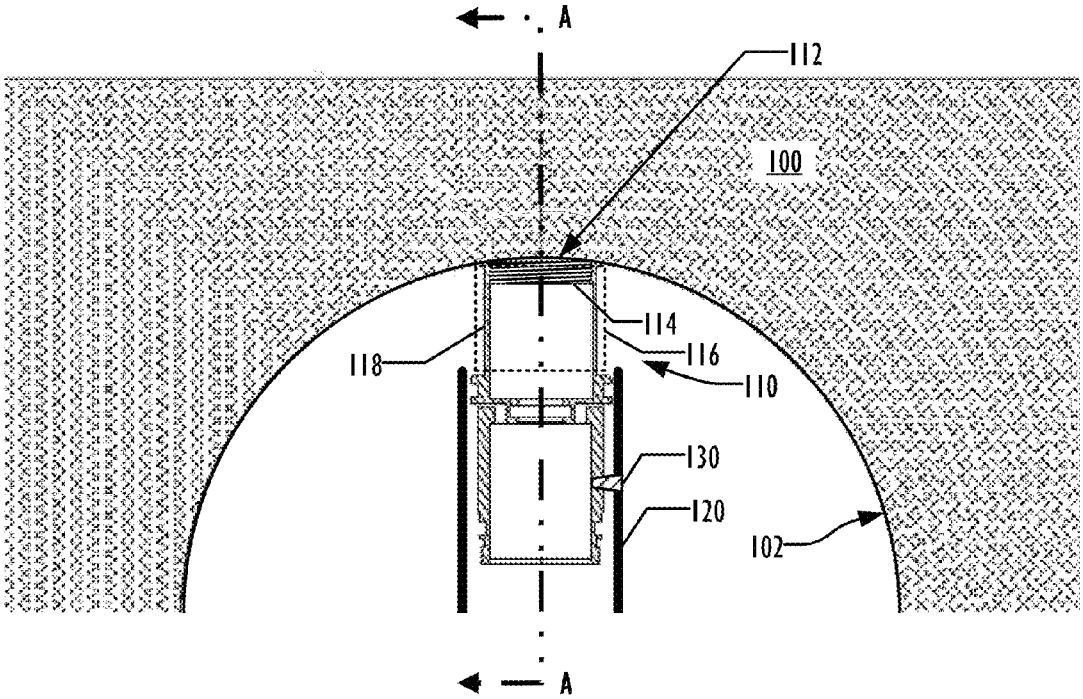
FIG. 1 is a cross-sectional view of a snorkel according to one embodiment.
Figure 5:
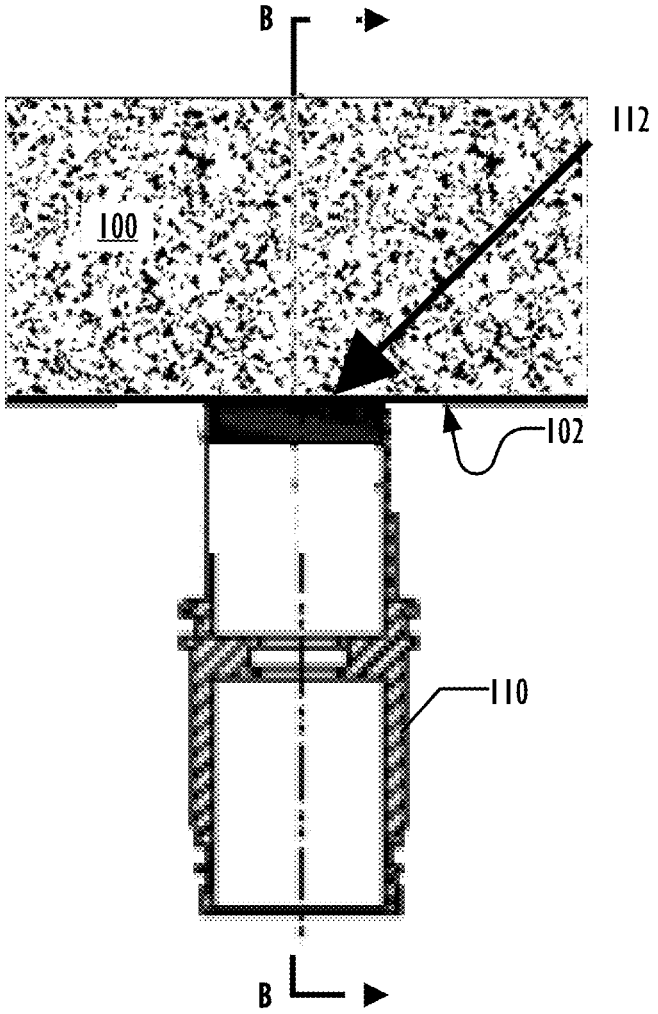
FIG. 5 is another cross-sectional view of the snorkel of FIG. 1, orthogonal to the cross-sectional view of FIG. 1

FIGS. 1 and 5 are orthogonal cross-section views of a snorkel 110 according to one embodiment. FIG. 1 is a cross section view along line B-B of FIG. 5, while FIG. 5 is a cross-sectional view along line A-A of FIG. 1. For purposes of clarity, only the snorkel 110 of the formation tester tool is illustrated in FIGS. 1 and 5.

As illustrated in FIG. 1, the snorkel 110 has been extended from piston cylinder 120 through the pad 116 (shown in phantom) to make contact with surface 102 of the borehole formed in formation 100. A screen 114 is preferably threaded into the body 118 of the snorkel, to screen cuttings or other solid matter from entering the snorkel 110. Other common elements of a snorkel, such as a mud plug, are omitted for clarity. Instead of a flat interface surface as in a conventional snorkel, radially outward surface 112 of the snorkel body 118 has been machined or otherwise formed to a cylindrical geometry, with the cylinder oriented parallel to the longitudinal axis of the borehole. The radius of the cylindrical geometry is sized to correspond to the radius of the borehole, so that the curved edge of the snorkel body 118 at the surface 112 matches the curvature of the surface 102 of the borehole.

Figure 2:
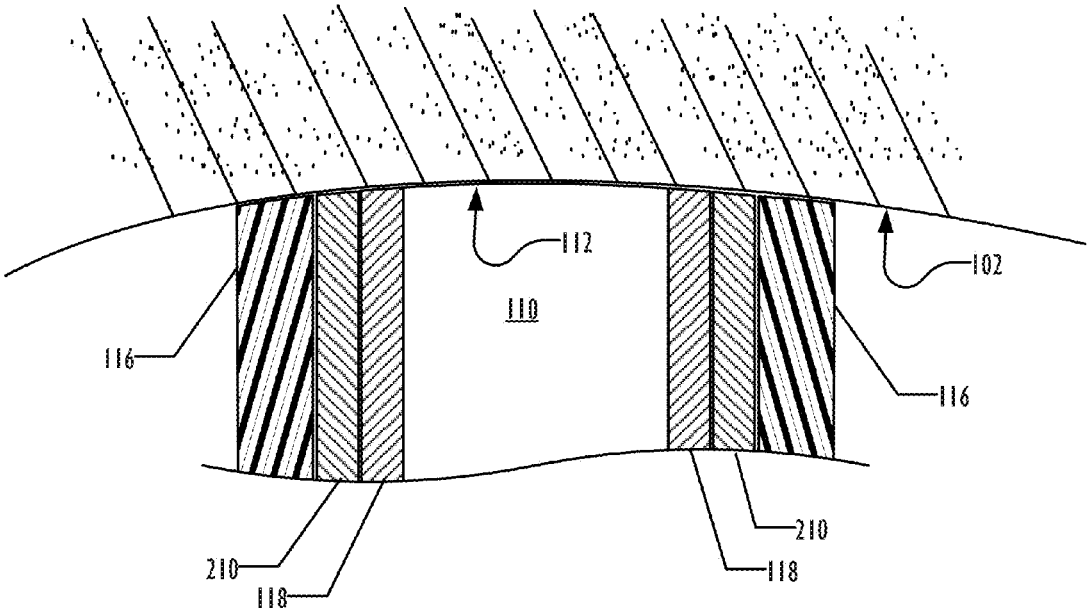
FIG. 2 is a detail view of the snorkel of FIG. 1.

As is best illustrated in FIG. 2, which is a detail view of the interface surface 112 of the snorkel 110 of FIG. 1, the curved interface surface 112 eliminates or minimizes the gap between the borehole surface 102 and the interface surface 112. By minimizing the gap, the potential for the pad 116 to extrude through that gap into the interior of the snorkel 110 is also minimized. The wellbore is not required to be perfectly circular, nor the snorkel's cylindrical diameter to be exactly the same as the wellbore. If the snorkel 110's cylindrical diameter does not exactly match that of the wellbore, even though a gap would exist between the curved interface surface 112 and the borehole surface 102, the gap would be smaller than that produced by a flat interface surface.

The pad 116 is typically designed with a cylindrical surface made of an elastomeric material such as a rubber. In one embodiment, the pad 116 includes a structural support element 210 to reduce the rubber extrusion. The support element 210 may also have a cylindrical geometry similar to that of the snorkel 110.

The snorkel 110 is configured to make contact with the surface 102 in a desired rotational orientation. Conventional snorkels are allowed to rotate. If the snorkel 110 were to rotate so that the cylindrical geometry of the interface surface 112 was oriented orthogonal to the longitudinal axis of the borehole, instead of parallel to the longitudinal axis of the borehole, rather than minimizing the gap between the snorkel 110 and the borehole surface 102, the cylindrical geometry would increase the gap over that caused by the flat interface surface of a conventional snorkel. Therefore, in one embodiment, the body 118 of the snorkel may be keyed, allowing insertion of an anti-rotation pin 130 to prevent rotation of the snorkel body 118 relative to the piston cylinder 120 as the snorkel 110 extends or retracts, thus ensuring the desired orientation of the snorkel 110 relative to the borehole. The configuration and placement of the anti-rotation pin 130 of FIG. 1 is illustrative and by way of example only. The anti-rotation pin 130 may be placed in any desired location. Other techniques for preventing rotation of the snorkel 110 relative to the borehole may be used as desired.

In another embodiment, the snorkel 110 may be formed with an elliptical or other non-circular body 118 to prevent undesired rotation of the snorkel 110 relative to the piston cylinder 120, and thus to the borehole.

Figure 3:
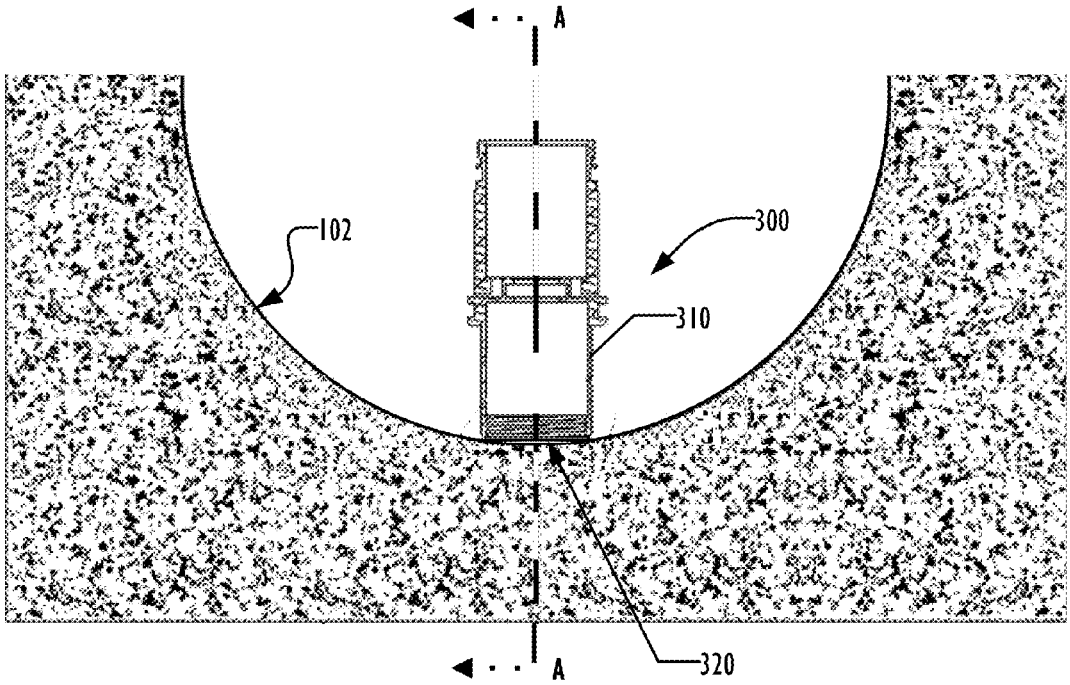
FIG. 3 (PRIOR ART)
FIG. 3 is a cross-sectional view of a snorkel according to the prior art.
Figure 4:
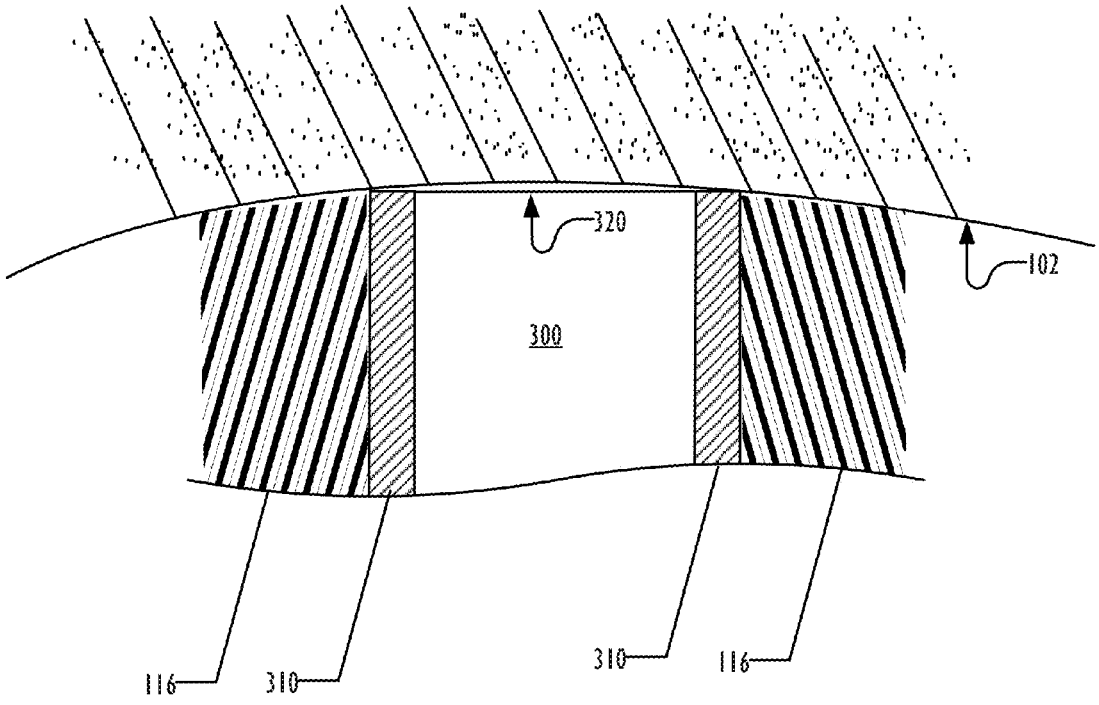
FIG. 4 (PRIOR ART)
FIG. 4 is a detail view of the snorkel of FIG. 2.

FIG. 3 is a view of a snorkel 300 according to the prior art that has been extended to make contact with the surface 102 of the borehole formed in formation 100. FIG. 3 is oriented in the same orientation as FIG. 1. As illustrated in FIG. 3, the flat interface surface 320 of the body 310 of the snorkel 300 does not match the curvature of the borehole surface 102. Thus, as best illustrated in the detail view of FIG. 4, the flat surface 320 creates a gap between the flat interface surface 320 and the surface 102 of the borehole, leaving room for extrusion of the surface pad 116 through that opening. The extrusion may damage the pad 116, the snorkel 300, or both.

Figure 6:
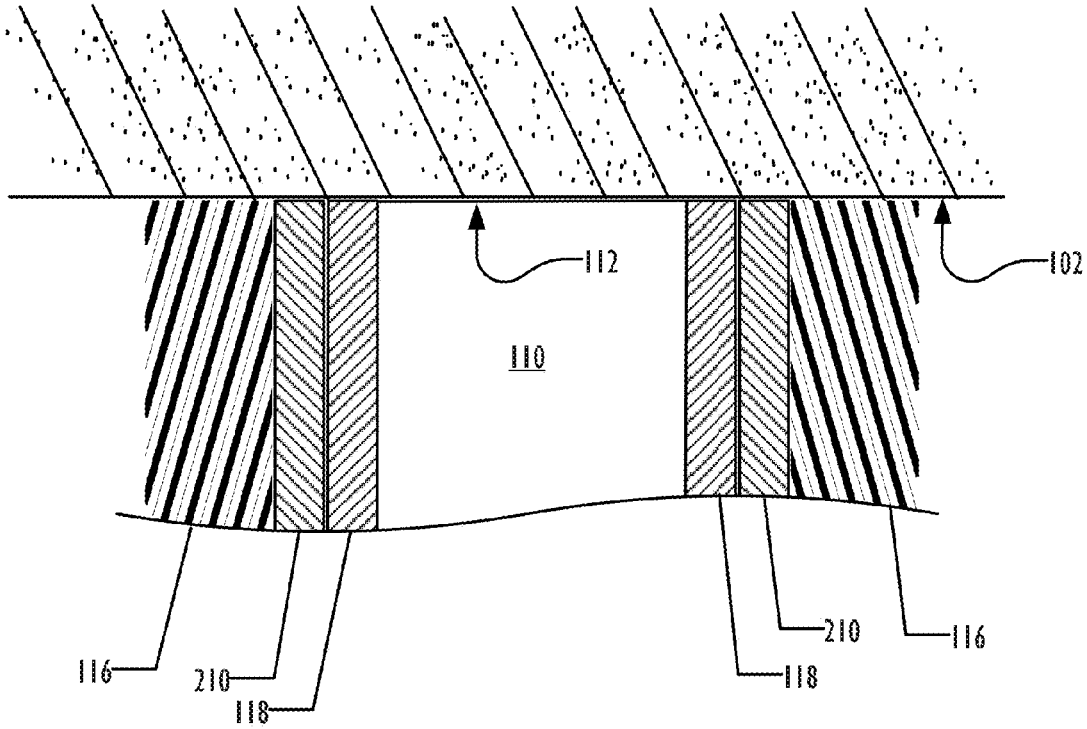
FIG. 6 is a detail view of the snorkel of FIG. 1 in the view of FIG. 5.

FIG. 5, oriented orthogonally to FIG. 1, is a cross-sectional view along line A-A of FIG. 1 that illustrates that the cylindrical geometry machined into the surface 112 of the snorkel 110 avoids a gap between the interface surface 112 and the surface 102 of the borehole. As best illustrated in the detail view of FIG. 6, the cylindrical geometry of the interface surface 112 of the snorkel 110 allows the snorkel surface 112 to rest on the surface 102 along the line A-A, preventing extrusion of the pad 116 into the snorkel 110.

Figure 7:
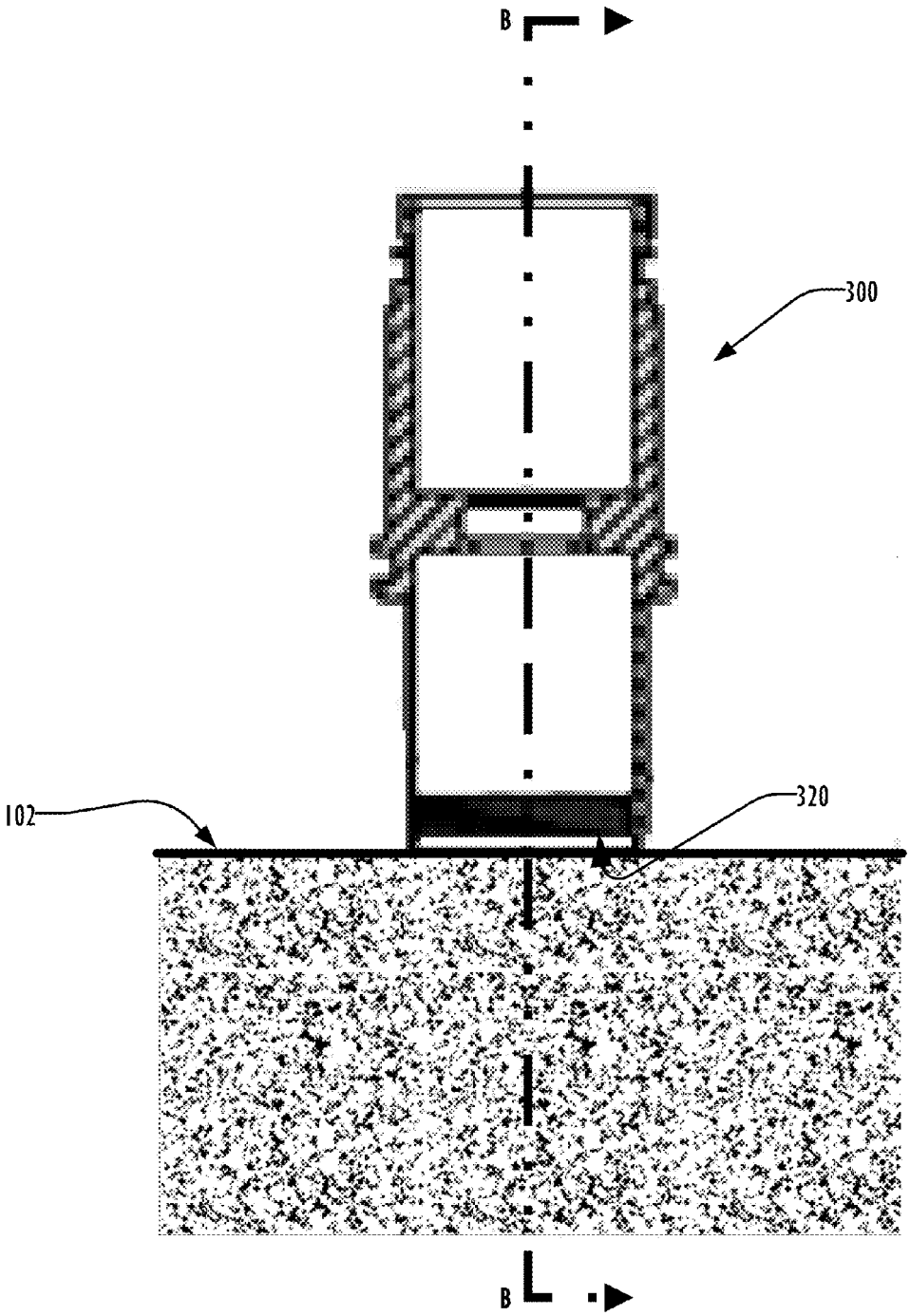
FIG. 7 (PRIOR ART)
FIG. 7 is a cross-sectional view of the prior art snorkel of FIG. 3, orthogonal to the cross-sectional view of FIG. 3.
Figure 8:
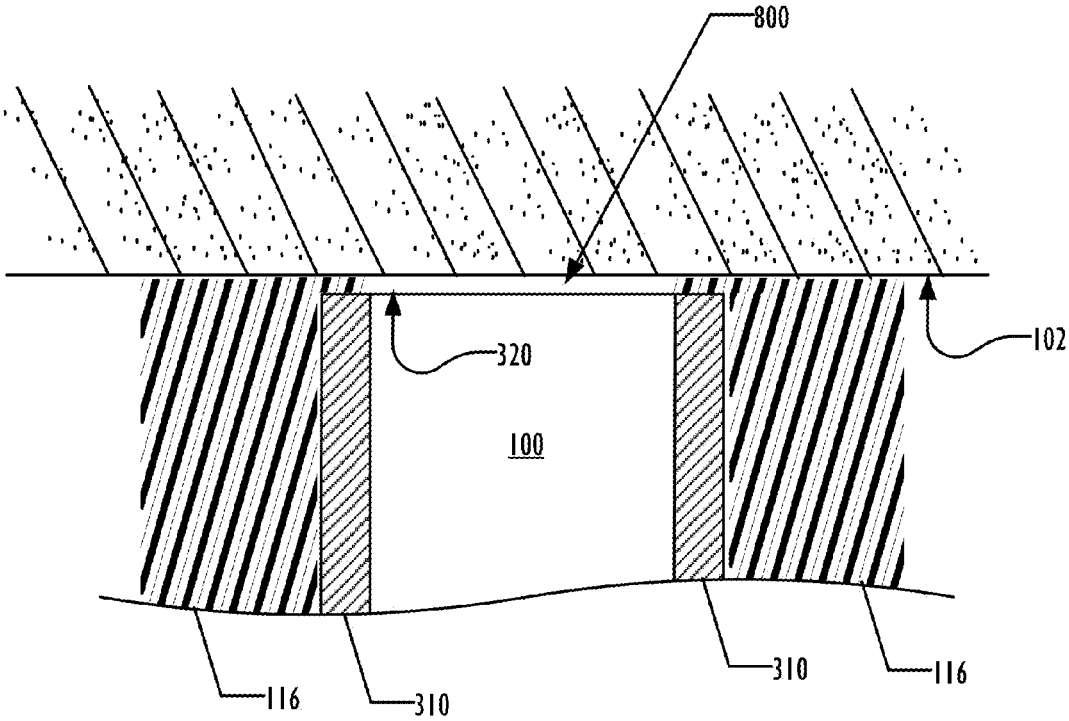
FIG. 8 (PRIOR ART)
FIG. 8 is a detail view of the snorkel of FIG. 3 in the view of FIG. 7.

In contrast, prior art snorkel 300 when viewed along line A-A, as illustrated in FIG. 7 and in detail view FIG. 8, does not contact the surface 102 at any point along line A-A, presenting a gap 800 and into which the pad 116 may extrude.

By using a cylindrical geometry at the interface surface 112 of a snorkel 110, a properly oriented snorkel 110 that is configured for the size of the borehole, extrusion of the sample pad between the borehole surface 102 and the snorkel interface surface 112 can be minimized or eliminated. Using an internal support element 210 that also has a cylindrical geometry may further reduce extrusion of the pad 116.

Figure 9:
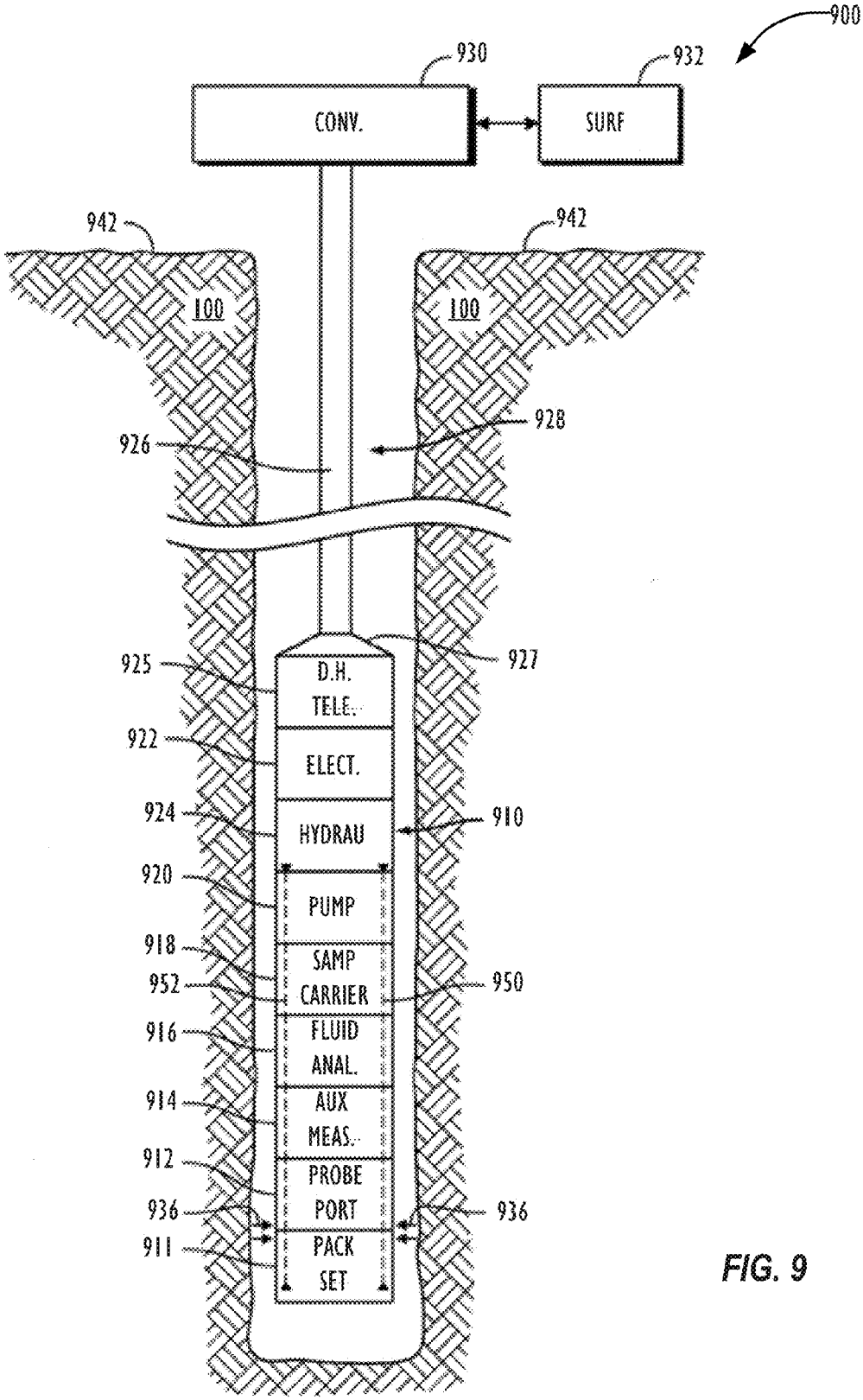
FIG. 9 is an elevation view of a formation tester according to one embodiment.

FIG. 9 illustrates conceptually the major elements of an embodiment of a formation tester system 900 that employs one or more snorkel's 110 as described above, operating in a well borehole 928 that penetrates earth formation 100.

The formation tester borehole instrument or tool 910 comprises a plurality of operationally connected sections including a packer section 911, a probe or port section 912, an auxiliary measurement section 914, a fluid analysis section 916, a sample carrier section 918, a pump section 920, a hydraulics section 924, an electronics section 922, and a downhole telemetry section 925. Two fluid flow lines 950 and 952 are illustrated conceptually with broken lines and extend contiguously through the packer, probe or port tool, auxiliary measurement, fluid analysis, sample carrier, and pump sections 911, 912, 914, 916, 918 and 920, respectively. Although two fluid flow lines 950 and 952 are illustrated in FIG. 9, embodiments of the tool 910 may use one fluid flow line or more than 2 fluid flow lines as desired.

Fluid is drawn into the tester tool 910 through a snorkel 110 of a probe or port tool section 912. The probe or port section 912 can comprise one or more snorkels 110 as input ports. Fluid flow into the probe or port section 912 is illustrated conceptually with the arrows 936. During the borehole drilling operation, the borehole fluid and fluid within or near the borehole formation 100 may be contaminated with drilling fluid typically comprising solids, fluids, and other materials. Drilling fluid contamination of fluid drawn from the formation 100 is typically minimized using one or more probes cooperating with a borehole isolation element such as the pad 116 and the snorkel 110. One or more snorkels 110 extend from the pad onto the formation 100 as described above. The formation 100 may further be isolated from the borehole 928 by one or more packers controlled by the packer section 911. A plurality of packers can be configured axially as straddle packers.

Fluid passes from the probe or port section 912 through one or more flow lines 950 and 952 under the action of the pump section 920. The pump section 920 cooperating with other elements of the tool 910 allows fluid to be transported within the flow lines 950 and 952 upward or downward through various tool sections.

An auxiliary fluid measurement may be made using auxiliary measurement section 914. The auxiliary measurement section 914 typically comprises one or more sensors that measure various physical parameters of the fluid flowing within one or more of the flow lines 950 and 952.

The fluid analysis section 916 is typically used to perform fluid analyses on the fluid while the tool 910 is disposed within the borehole 928. As an example, fluid analyses can comprise the determination of physical and chemical properties of oil, water, and gas constituents of the fluid.

Fluid is directed via one or more of the flow lines 950 and 952 to the sample carrier section 918. Fluid samples can be retained within one or more sample containers within the sample carrier section 918 for return to the surface 942 of the earth for additional analysis. The surface 942 is typically the surface of earth formation 100 or the surface of any water covering the earth formation 100.

The hydraulic section 924 provides hydraulic power for operating numerous valves and other elements within the tool 910. The electronics section 922 comprises necessary tool control to operate elements of the tool 910, motor control to operate motor elements in the tool 910, power supplies for the various section electronic elements of the tool 910, power electronics, an optional telemetry for communication over a wireline to the surface, an optional memory for data storage downhole, and a tool processor for control, measurement, and communication to and from the motor control and other tool sections. The individual tool sections may also contain electronics (not shown) for section control and measurement.

The tool 910 may have a downhole telemetry section 925 for transmitting various data measured within the tool 910 and for receiving commands from surface 942 of the earth. The downhole telemetry section 925 can also receive commands transmitted from the surface 942 of the earth. The upper end of the tool 910 is terminated by a connector 927. The tool 910 is operationally connected to a conveyance apparatus 930 disposed at the surface 942 by means of a connecting structure 926 that is typically a tubular or a cable. More specifically, the lower or downhole end of the connecting structure 926 is operationally connected to the tool 910 through the connector 927. The upper or uphole end of the connecting structure 926 is operationally connected to the conveyance apparatus 930. The connecting structure 926 can function as a data conduit between the tool 910 and equipment disposed at the surface 942.

If the tool 910 is a logging tool element of a wireline formation tester system, the connecting structure 926 may comprise a multi-conductor wireline logging cable and the conveyance apparatus 930 may be a wireline draw works assembly comprising a winch. If the tool 910 is a component of a measurement-while-drilling or logging-while-drilling system, the connecting structure 926 may be a drill string and the conveyance apparatus 930 may be a rotary drilling rig. If the tool 910 is an element of a coiled tubing logging system, the connecting structure 926 may be coiled tubing and the conveyance apparatus 930 may be a coiled tubing injector. If the tool 910 is an element of a drill string tester system, the connecting structure 926 may be a drill string and the conveyance apparatus 930 may be a rotary drilling rig.

Surface equipment 932 is operationally connected to the tool 910 through the conveyance apparatus 930 and the connecting structure 926. The surface equipment 932 comprises a surface telemetry element (not shown), which communicates with the downhole telemetry section 925. The connecting structure 926 functions as a data conduit between the downhole and surface telemetry elements. The surface unit 932 typically comprises a surface processor that optionally performs additional processing of data measured by sensors and gauges in the tool 910. The surface processor also cooperates with a depth measure device (not shown) to track data measured by the tool 910 as a function of depth within the borehole 928 at which it is measured. The surface equipment 932 typically comprises recording means for recording logs of one or more parameters of interest as a function of time and/or depth.

FIG. 9 is illustrative and by way of example only, and illustrates basic concepts of an embodiment of the system 900 that employs the snorkel 110. The system 900 may be incorporated in a more general downhole fluid analysis device. The various sections of the tool 910 may be arranged in different axial configurations, and multiple sections of the same type may be added or removed as desired for specific borehole operations. Some tools 910 may omit one or more of the sections described above as desired.

It is to be understood that the above description is intended to be illustrative, and not restrictive. For example, the above-described embodiments may be used in combination with each other. Many other embodiments will be apparent to those of skill in the art upon reviewing the above description. The scope of the invention therefore should be determined with reference to the appended claims, along with the full scope of equivalents to which such claims are entitled. In the appended claims, the terms "including" and "in which" are used as the plain-English equivalents of the respective terms "comprising" and "wherein."

What is claimed is:

1. A method, comprising:

reducing an extrusion gap between a borehole interface surface of a first snorkel of a formation testing tool and a surface of a borehole, comprising:

forming a cylindrical geometry at a borehole interface of the first snorkel;

extending the first snorkel through an opening in a protective pad disposed about the first snorkel, wherein the cylindrical geometry is operationally axially aligned parallel to a longitudinal axis of the borehole.

2. The method of claim 1, wherein the cylindrical geometry has a radius determined by a radius of the borehole.

3. The method of claim 1, further comprising:

replacing the first snorkel with a second snorkel having a cylindrical geometry with a different cylindrical radius.

4. The method of claim 1, wherein the pad has a cylindrical geometry having a radius determined by a radius of the borehole.

5. The method of claim 4, wherein the act of forming a cylindrical geometry at a borehole interface of the first snorkel further comprises:

disposing a support element with the pad, the support element having a cylindrical geometry oriented parallel to the longitudinal axis of the borehole.

6. The method of claim 1, further comprising:

preventing rotation of the first snorkel relative to the borehole.

7. The method of claim 6, wherein the act of preventing rotation of the first snorkel relative to the borehole comprises:

keying a body of the first snorkel;

inserting the first snorkel into a piston cylinder; and preventing rotation of the body of the first snorkel relative to the piston cylinder with an anti-rotation pin.

8. The method of claim 6, wherein the act of preventing rotation of the first snorkel relative to the borehole comprises:

forming a body of the first snorkel with a non-circular cross-section.

9. A snorkel for use in a formation testing tool, comprising:

a tubular body, configured for extension from and retraction into a piston cylinder of the formation testing tool, wherein the tubular body when extended from the piston cylinder, extends through an opening in a pad; and a borehole interface, formed at a radially outward and of the tubular body, having a cylindrical geometry, wherein the cylindrical geometry of the borehole interface is operationally axially aligned parallel to a longitudinal axis of the borehole.

10. The snorkel of claim 9, wherein the tubular body is substantially circular in cross-section.

11. The snorkel of claim 9, wherein the tubular body is keyed to prevent rotation of the tubular body relative to the piston cylinder.

12. The snorkel of claim 11, further comprising:

an anti-rotation pin, disposed with the tubular body and the piston cylinder, wherein the anti-rotation pin prevents rotation of the tubular body relative to the piston cylinder.

13. A system for testing an earth formation surrounding a borehole, comprising:

a formation testing tool, comprising:

a plurality of sections, at least one of which comprises:

a piston cylinder; and a first snorkel configured for extension from and retraction into the piston cylinder, comprising:

a tubular body, configured for extension from and retraction into the piston cylinder;

a pad, disposed about the tubular body, wherein the tubular body extends through an opening in the pad when extended from the piston cylinder; and a borehole interface, formed at a radially outward end of the tubular body, having a cylindrical geometry, wherein the cylindrical geometry of the borehole interface is operationally axially aligned parallel to a longitudinal axis of the borehole;

a conveyance apparatus; and a connecting structure operationally connecting the formation testing tool to the conveyance apparatus to convey the formation testing tool in the borehole.

14. The system of claim 13, wherein a radius of the cylindrical geometry is configured to correspond to a radius of the borehole.

15. The system of claim 13, wherein the first snorkel is replaceable with a second snorkel wherein the borehole interface of the second snorkel has a cylindrical geometry with a different cylindrical radius than the cylindrical radius of the cylindrical geometry of the borehole interface of the first snorkel.

16. The system of claim 13, wherein the tubular body is substantially circular in cross-section.

17. The system of claim 13, wherein the tubular body is keyed to prevent rotation of the tubular body relative to the piston cylinder.

18. The system of claim 17, wherein the first snorkel further comprises an anti-rotation pin, disposed with the tubular body and the piston cylinder, wherein the anti-rotation pin prevents rotation of the tubular body relative to the piston cylinder.

19. A formation testing tool, comprising:

a plurality of sections, at least one of which comprises:

a pad, comprising:

an elastomeric element, configured for sealing with a surface of the borehole; and a piston cylinder; and a first snorkel configured for extension from and retraction into the piston cylinder, the pad disposed about the first snorkel, the first snorkel comprising:

a tubular body, configured for extension from and retraction into the piston cylinder, wherein the tubular body when extended from the piston cylinder, extends through an opening in the pad; and a borehole interface, formed at a radially outward end of the tubular body, having a cylindrical geometry, wherein the cylindrical geometry of the borehole interface is operationally axially aligned parallel to a longitudinal axis of the borehole.

20. The formation testing tool of claim 19, wherein the first snorkel further comprises an anti-rotation pin, disposed with the tubular body and the piston cylinder, wherein the anti-rotation pin prevents rotation of the tubular body relative to the piston cylinder.

21. The formation testing tool of claim 19, wherein the first snorkel is replaceable with a second snorkel wherein the borehole interface of the second snorkel has a cylindrical geometry with a different cylindrical radius than the cylindrical radius of the cylindrical geometry of the borehole interface of the first snorkel.

22. The formation testing tool of claim 19, further comprising:

a support element, disposed between the elastomeric element and the first snorkel, having a cylindrical geometry that is operationally axially aligned parallel to a longitudinal axis of the borehole.

* * * * *